US010435045B2

(12) United States Patent
Gao

(10) Patent No.: US 10,435,045 B2
(45) Date of Patent: Oct. 8, 2019

(54) ANTI-DERAILMENT APPARATUS FOR BOGIE OF A RAIL VEHICLE AND BOGIE OF A RAIL VEHICLE

(71) Applicant: CENTRAL SOUTH UNIVERSITY, Changsha, Hunan (CN)

(72) Inventor: Guangjun Gao, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 0 days.

(21) Appl. No.: 15/522,919

(22) PCT Filed: Jan. 18, 2016

(86) PCT No.: PCT/CN2016/071194
§ 371 (c)(1),
(2) Date: Apr. 28, 2017

(87) PCT Pub. No.: WO2017/063315
PCT Pub. Date: Apr. 20, 2017

(65) Prior Publication Data

US 2018/0208218 A1 Jul. 26, 2018

(30) Foreign Application Priority Data

Oct. 16, 2015 (CN) ..... 2015 1 0664823

(51) Int. Cl.
*B61F 9/00* (2006.01)
*B61F 5/50* (2006.01)

(52) U.S. Cl.
CPC . *B61F 9/00* (2013.01); *B61F 5/50* (2013.01)

(58) Field of Classification Search
CPC ..... B61F 3/00; B61F 3/02; B61F 9/00; B61F 19/00; B61F 19/02
See application file for complete search history.

(56) References Cited

U.S. PATENT DOCUMENTS 6,322,121 B1 11/2001 French
8,261,671 B2 9/2012 Sakanoue
(Continued)

FOREIGN PATENT DOCUMENTS

CH 677908 A5 7/1991
CN 200945860 Y 9/2007
(Continued)

OTHER PUBLICATIONS

International Search Report in international application No. PCT/CN2016/071194, dated Jun. 22, 2016.
(Continued)

*Primary Examiner* — Robert J McCarry, Jr.
(74) *Attorney, Agent, or Firm* — Syncoda LLC; Feng Ma

(57) ABSTRACT

An anti-derailment apparatus for a bogie of a rail vehicle of the disclosure comprises at least one mounting seat and an anti-derailment slide plate. The transverse orientation of the anti-derailment slide plate on the mounting seat and the extending length of the anti-derailment slide plate in the vertical direction meet the following requirements simultaneously: 1) making the anti-derailment slide plate located at the inside of the ground rail when the rail vehicle runs normally; 2) when at least one wheelset of the rail vehicle climbs rail, the anti-derailment slide plate acts on the ground rail to form lateral limitation points so as to limit the freedom of the rail vehicle and make it still constrained by the ground rail.

20 Claims, 5 Drawing Sheets

(56) References Cited

U.S. PATENT DOCUMENTS

| | | | |
|---|---|---|---|
| 8,707,871 | B2 | 4/2014 | Moon |
| 2006/0124024 | A1 | 6/2006 | Hachikawa |
| 2009/0301343 | A1 | 12/2009 | Sakanoue |
| 2012/0037715 | A1 | 2/2012 | Sakanoue |
| 2013/0068126 | A1 | 3/2013 | Moon |

FOREIGN PATENT DOCUMENTS

| | | | | | |
|---|---|---|---|---|---|
| CN | 101229812 | A | | 7/2008 | |
| CN | 101400559 | A | | 4/2009 | |
| CN | 201427587 | Y | | 3/2010 | |
| CN | 201633743 | U | | 11/2010 | |
| CN | 102414071 | A | | 4/2012 | |
| CN | 202225875 | U | | 5/2012 | |
| CN | 103038119 | A | | 4/2013 | |
| CN | 203439052 | U | | 2/2014 | |
| CN | 203727397 | U | | 7/2014 | |
| CN | 104354712 | A | | 2/2015 | |
| CN | 104627195 | A | | 5/2015 | |
| CN | 204548142 | U | | 8/2015 | |
| CN | 105383511 | A | | 3/2016 | |
| CN | 205440382 | U | | 8/2016 | |
| DE | 19838112 | A1 | | 1/2000 | |
| EP | 2426026 | A1 | | 3/2012 | |
| FR | 2755658 | B1 | | 12/1998 | |
| JP | 2006151349 | A | | 6/2006 | |
| JP | 2006327565 | A | | 12/2006 | |
| JP | 2011168078 | A | | 9/2011 | |
| JP | 5133237 | B2 | | 1/2013 | |
| JP | 5214379 | | * | 6/2013 | ..... B61F 9/00 |
| JP | 5214379 | B2 | | 6/2013 | |
| JP | 5280911 | B2 | | 9/2013 | |
| KR | 100969195 | B1 | | 7/2010 | |

OTHER PUBLICATIONS

Supplementary European Search Report in European application No. 16852875.0, dated Sep. 5, 2017.

The Written Opinion of the International Search Authority in international application No. PCT/CN2016/071194, dated Jun. 22, 2016.

* cited by examiner

ANTI-DERAILMENT APPARATUS FOR BOGIE OF A RAIL VEHICLE AND BOGIE OF A RAIL VEHICLE

TECHNICAL FIELD

The disclosure relates to the technical field of rail transit devices, in particular to a mechanical apparatus which can prevent bogies of a rail vehicle from occurring derailment accidents during operation.

BACKGROUND

Nowadays, with the improvement of the running speed and transport efficiency of trains, if a train occurs derailment, circumstances such like line close, train shutting down or delay will be caused. Therefore, the requirement for the anti-derailment performance of bogies is higher and higher, especially to the main line railway where the transportation is relatively busy.

The bogie without fixing an anti-derailment apparatus relies only on the flange of the wheel itself for taking precautions against the anti-derailment of the bogie. Since the constrained points are relatively fewer, the anti-derailment capability is relative weak.

The Chinese patent application with the publication No. CN204548142U discloses a rail vehicle and safety protection apparatus for anti-derailment. The basic principle of the apparatus is to allow the safety protection apparatus to contact with the outside of the rail after the wheelset is separated from the steel rail, so as to avoid the whole bogie separating from the railway line. The safety protection apparatus allows the wheelset to be separated from the rail, and then avoids the lateral movement of the vehicle being too much by use of the apparatus. The function of the apparatus works only after the vehicle occurs derailment. The bogie without fixing the above safety protection apparatus cannot effectively limit derailment accidents such as rail climbing, and after the wheelset is separated from the rail, the lateral vibration of the vehicle is relatively large.

SUMMARY

The technical problem to be solved by the disclosure is to overcome the shortage and defect as mentioned above in the Background. The disclosure provides an anti-derailment apparatus for a bogie of a rail vehicle and an anti-derailment bogie of a rail vehicle, the apparatus can avoid the bogie of the rail vehicle from occurring derailment during operation, especially can avoid derailment which may occur after the wheelset climbing rail, increasing safety and transport efficiency of the train.

In order to solve the above technical problem, the technical solution of disclosure is an anti-derailment apparatus for a bogie of a rail vehicle. The anti-derailment apparatus comprises at least one mounting seat which is mounted at the bottom of the bogie of a rail vehicle, and an anti-derailment slide plate arranged on the mounting seat (1) extending toward the ground rail; a transverse position of the anti-derailment slide plate on the bogie and the extending length of the anti-derailment slide plate (2) in the vertical direction (i.e., the vertical length) are set to meet the following requirements simultaneously:

1) always making the anti-derailment slide plate located at the inside of the ground rail when the rail vehicle runs normally;

2) when at least one wheelset of the rail vehicle climbs rail, the anti-derailment slide plate acts on the ground rail (that is, contacts with the inside of the rail) to form lateral limitation points so as to limit the freedom (generally, the freedom comprises lateral movement freedom and swing freedom) of the rail vehicle (for example, the bogie system) and make it still constrained by the ground rail. In the state of such constraint, the anti-derailment slide plate forces the wheelset climbing rail to centre automatically, and resume to the normal position from the state of climbing rail.

The above technical solution of the disclosure is based on the following concept: when the wheelset climbs rail so that the bogie of a rail vehicle has a derailment tendency, the anti-derailment apparatus contacts with the inside of the rail, and by means of the stability of a triangular system constituted together by the rigidity of the bogie and the contact of the anti-derailment apparatus with the wheelset, a further lateral displacement of the wheelset climbing rail is limited, and the wheelset climbing rail centres automatically, resuming to the normal position from the state of climbing rail and avoiding the occurrence of derailment. The anti-derailment apparatus of the disclosure can not only effectively prevent the lateral separation between the wheelset and the rail, but also can continuously act the protection function during the train operation, thereby always achieving the anti-derailment effect.

In the above anti-derailment apparatus for the bogie of a rail vehicle, preferably, the anti-derailment apparatus comprises a pair of mounting seats which are mounted at the bottom of the bogie. The pair of mounting seats comprise a first mounting seat which is located at the left side of the bottom of the bogie and a second mounting seat which is located at the right side of the bottom of the bogie. Each of the first mounting seat and the second mounting seat are configured with the anti-derailment slide plate. Preferably, the first mounting seat and the second mounting seat are arranged symmetrically along the centre line of the ground rail. Upon using such a preferable solution, the synchronous protection of the rail vehicle at both sides can be achieved, ensuring that an effective precaution can be made when the train runs in forward and reverse directions as well as derails at the left and right sides.

In the above anti-derailment apparatus for the bogie of a rail vehicle, preferably, the transverse position of the anti-derailment slide plate is achieved by controlling the lateral distance of the anti-derailment slide plate and the flange of the wheelset. Preferably, the anti-derailment slide plate and the flange are located at the same line. When the transverse position meets the above requirements, not only the interference of the anti-derailment slide plate with the inside of the rail can be reduced to the greatest extent, but also the anti-derailment apparatus can be initiated once the wheelset derails, reducing the occurrence of derailment accidents to the greatest extent.

In the above anti-derailment apparatus for the bogie of a rail vehicle, preferably, the extending length of the anti-derailment slide plate in the vertical direction (i.e., the vertical length) is not smaller than the height of the flange of the wheelset. Preferably, the extending length of the anti-derailment slide plate in the vertical direction is achieved by controlling the height of the lower surface of the anti-derailment apparatus (with respect to ground). Of course, when the transverse position on the mounting seat ensures that the anti-derailment slide plate and the flange are located at the same line, a more preferable way is setting the extending length of the anti-derailment slide plate so that the height of the lower surface of the anti-derailment apparatus is aligned with the height of the flange. Such a setting can not only ensure that the anti-derailment apparatus always acts during the train operation, but also cannot make the contact of the middle anti-derailment slide plate with the inside of the rail ineffective while one wheelset climbs rail, and also reduce the interference of the anti-derailment slide plate with the rail as much as possible.

In the above anti-derailment apparatus for the bogie of a rail vehicle, preferably, the anti-derailment slide plate is configured to be a slide plate of which the extending length is adjustable. A more preferable and more compact setting way is: the mounting seat is provided with a strip-shaped sliding groove which extends along the vertical direction, and the anti-derailment slide plate is configured on the mounting seat through the fastener which can slide upward and downward within the sliding groove. The contact surfaces of the anti-derailment slide plate and the mounting seat are configured to be zigzag butting surfaces which mesh with each other. Since the extending length is adjustable, that is, the height of the lower surface of the anti-derailment slide plate can be adjusted upward and downward, the interference of the slide plate with the infrastructure (here, the infrastructure mainly refers to the rail) due to the reduction of the radius of the wheel resulting from the re-profiling repair of the wheelset can be avoided better. Moreover, the adjustable characteristic of the anti-derailment slide plate can also make the anti-derailment apparatus mounted on bogies of different vehicles so as to adjust the lower surface of the anti-derailment slide plate to keep an optimal position with the flange.

In the above anti-derailment apparatus for the bogie of a rail vehicle, preferably, the mounting seat is an L shape, and the L shaped mounting seat comprises a horizontal top surface which can be fastened to the bogie through a fastener (for example, bolt), and also comprises a vertical side surface which can be fastened to the anti-derailment slide plate through another fastener. Of course, the mounting seat can also be fixed on the bogie by the way of welding, or integrally moulded with the side frame and the framework of the bogie upon manufacturing, but preferably connected through a fastener, facilitating the replacement after abrasive wear and applying to different rail vehicles, and the detachment of the anti-derailment apparatus due to the vibration of the framework or the side frame of the bogie may not occur, ensuring good anti-derailment performance.

In the above anti-derailment apparatus for the bogie of a rail vehicle, preferably, both sides of the lower portion of the anti-derailment slide plate are provided with a keep-space area. The keep-space area is disposed particularly at the side of the anti-derailment slide plate facing the ground rail, and the anti-derailment slide plate provided with the keep-space area is a tip shape or a wedge shape, ensuring that the whole anti-derailment apparatus has good switch-passing performance and does not interfere with the infrastructure.

As a general technical concept, the disclosure also provides an anti-derailment bogie of a rail vehicle which comprises a bogie and the above anti-derailment apparatus of the disclosure, each side of each bogie is mounted with the anti-derailment apparatus. The upper portion of the anti-derailment apparatus is mounted at the bottom of the bogie, and the lower portion of the anti-derailment apparatus hangs between the two front and rear wheelsets to which the bogie corresponds. The technical solution also ensures that the freedom of the bogie system can still be constrained by the rail when one wheelset of the bogie climbs rail, through adding lateral limitation points to the side frame or the framework of the bogie, thereby avoiding the occurrence of derailment accidents. Furthermore, preferably, the anti-derailment apparatus applies to the bogie system without axle-box springs or with axle-box springs having relatively great rigidity.

The above technical solutions of the disclosure are based mainly on the following principles: the existing bogie is in four-point contact substantially, and the four points are subject to the lateral constraint of the flange, and when the flange at one side climbs rail due to various external factors, the lateral constraint of the flange on one axle may be ineffective, which may cause occurrence of derailment accidents; with respect to the case where the lateral constraint reduces when the flange climbs rail, the disclosure designs in the way of adding lateral limitation points between the bogie and the rail, i.e., adding at least one or two lateral limitation points (lateral constraint points) at the middle of the bogie, so that constraint points between the bogie and the rail exceed four (reach 6 or more). When one wheel of the bogie climbs rail and loses the lateral constraint function, there are still at least four points on the bogie to maintain the lateral constraint, making the whole bogie on the rail still move along the rail, then the wheelset by its own automatic centering function can even resume the original operation state, avoiding the occurrence of derailment accidents.

Compared with the related art, the advantages of the disclosure lie in: the technical solutions of the disclosure can dedicate to prevent derailment of the bogie of a rail vehicle and can improve the anti-derailment performance of the bogie substantially. Meanwhile, the apparatus of the disclosure is simple in structure, low in cost, reliable in operation and free from maintenance, and when the bogie mounted with the anti-derailment apparatus runs on the railway line, losses coming from such as closing the railway line, shutting down the train, rescuing the train etc. due to derailment of the train will reduce greatly, greatly increasing safety and transport efficiency of the train.

BRIEF DESCRIPTION OF THE DRAWINGS

In order to explain the technical solutions in embodiments of the disclosure or related art more clearly, the accompanying drawings required to describe embodiments or related art will be briefly introduced below. Obviously, the accompanying drawings in the following description are described according to some embodiments of the disclosure, and those ordinary skilled in the art can also obtain other accompanying drawings according to these accompanying drawings without paying any creative effort.

EXPLANATION OF REFERENCE NUMBERS

1. mounting seat; 11. first mounting seat; 12. second mounting seat; 13. horizontal top surface; 14. vertical side surface; 15. sliding groove; 2. anti-derailment slide plate;

21. lower surface; 3. fastener; 4. anti-derailment apparatus; 5. keep-space area; 6. wheelset; 7. flange; 8. ground rail; 9. bogie.

DETAILED DESCRIPTION

In order to facilitate understanding of the disclosure, the disclosure will be described more completely and in detail hereinafter in combination with the accompanying drawings and preferable embodiments, however, the protection scope of the disclosure is not limited to the following particular embodiments.

It should be noted that when one element is described to be "fixed to, fastened to, connected to, or communicated to" another element, it can be directly fixed to, fastened to, connected to, or communicated to the another element, and it can also be indirectly fixed to, fastened to, connected to, or communicated to the another element through other intermediate connecters.

Unless defined otherwise, all terminologies used hereinafter have the same meaning as what commonly understood by those skilled in the art. The terminologies used herein are only for purpose of describing particular embodiments, and not intended to limit the protection scope of the disclosure.

Unless explained specially otherwise, various raw materials, reagents, instruments and devices etc. used in the disclosure are available in the market or can be prepared and obtained by existing methods.

Embodiment

Figure 4:
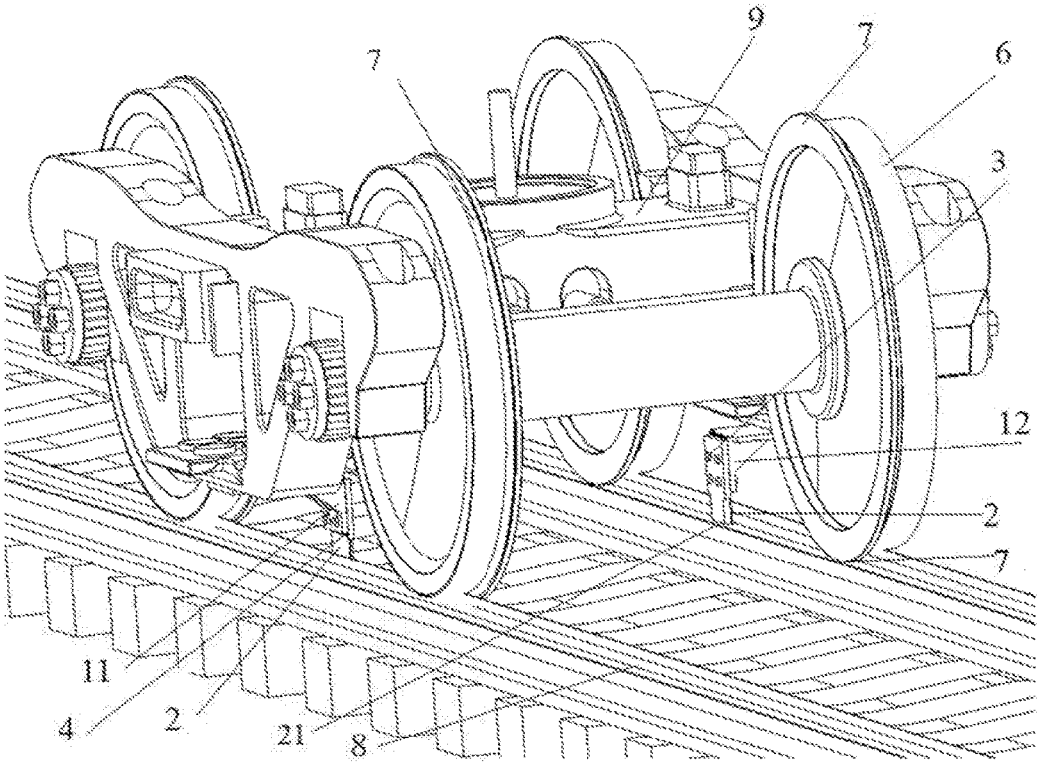
FIG. 4 is a schematic diagram of the installation of the anti-derailment apparatus on the bogie of the disclosure.

An anti-derailment bogie of a rail vehicle of the disclosure as shown in FIG. 4, comprises a bogie 9 and an anti-derailment apparatus 4. The upper portion of the anti-derailment apparatus 4 is mounted at the bottom of the bogie 9, and the lower portion of the anti-derailment apparatus 4 hangs between the two front and rear wheelsets 6 to which the bogie 9 corresponds.

FIGS. 1-4 also illustrates the anti-derailment apparatus 4 for the bogie of a rail vehicle of the disclosure, and the anti-derailment apparatus 4 comprises a pair of mounting seats 1 which are mounted at the bottom of the bogie 9 of the rail vehicle. The pair of mounting seats 1 comprise a first mounting seat 11 which is located at the left side of the bottom of the bogie 9 and a second mounting seat 12 which is located at the right side of the bottom of the bogie 9. Preferably, the first mounting seat 11 and the second mounting seat 12 can be arranged symmetrically along the centre line of the ground rail 8 (but it is not necessary), and each of the first mounting seat 11 and the second mounting seat 12 is configured with an anti-derailment slide plate 2 extending toward the ground rail 8.

Figure 2:
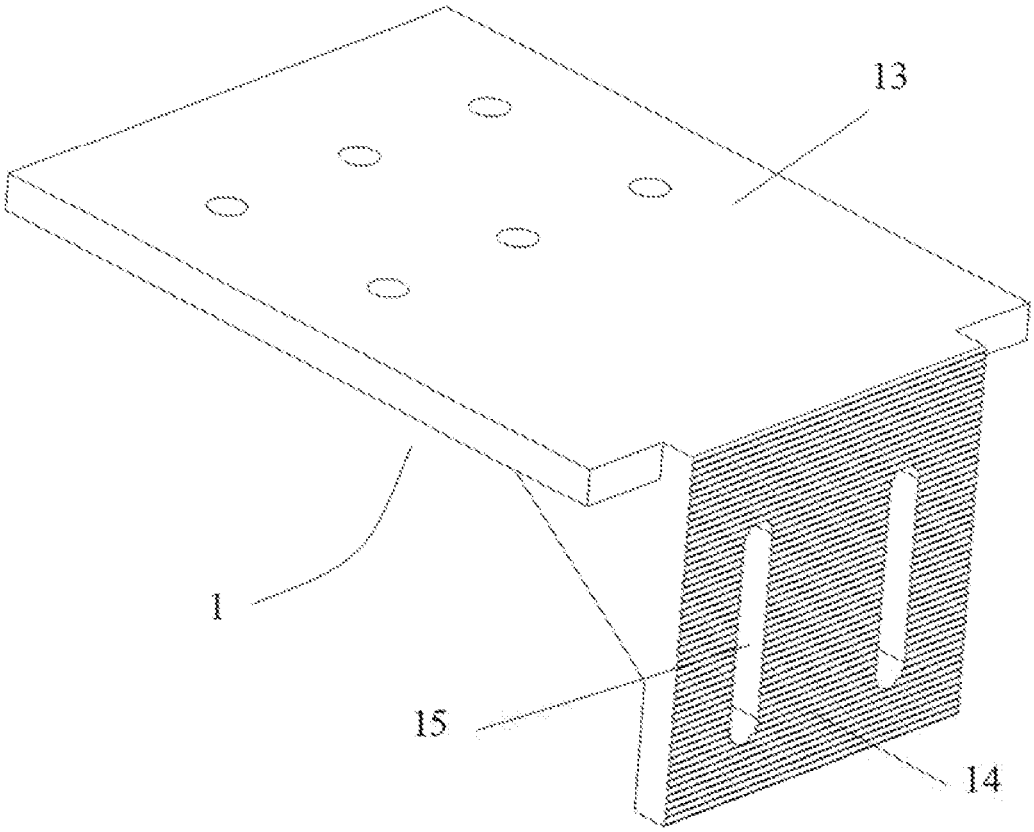
FIG. 2 is a schematic diagram of the structure of the mounting seat of the anti-derailment apparatus of the disclosure.

As shown in FIG. 2, the mounting seat 1 in the embodiment is an L shape, and the L shaped mounting seat 1 comprises a horizontal top surface 13 which can be fastened to the bogie 9 through the fastener 3 (in the embodiment, it is a bolt), and also comprises a vertical side surface 14 which can be fastened to the anti-derailment slide plate 2 through the fastener 3 (in the embodiment, it is a bolt). As such, both the anti-derailment slide plate 2 and the mounting seat 1 are detachable.

Figure 3:
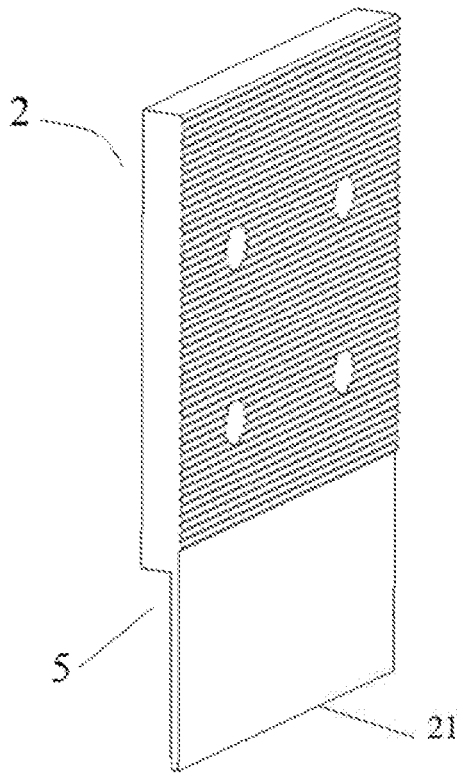
FIG. 3 is a schematic diagram of the structure of the anti-derailment slide plate of the anti-derailment apparatus of the disclosure.

As shown in FIGS. 2-3, the anti-derailment slide plate 2 of the embodiment is configured as a slide plate of which the vertical length or height is adjustable. In particular, the mounting seat 1 is provided with a strip-shaped sliding groove 15 which extends along the vertical direction, and the anti-derailment slide plate 2 is fitted on the mounting seat 1 through the fastener 3 which can slide upward and downward in the sliding groove 15. As shown in FIGS. 2-3, the contact surfaces of the anti-derailment slide plate 2 and the mounting seat 1 are configured as zigzag butting surfaces which mesh with each other (or in other ways of a relative large friction coefficient). Such a structure can achieve the upward and downward adjustment of the position of the anti-derailment slide plate 2, and can also adjust the height of the lower surface 21 of the anti-derailment slide plate 2 (further adjust the anti-derailment apparatus 4) through the zigzag meshing, avoiding the interference of the anti-derailment slide plate 2 with the infrastructure such as the ground rail 8 etc. caused due to the reduction of the radius of the wheel resulting from the re-profiling repair of the wheelset 6.

Figure 1:
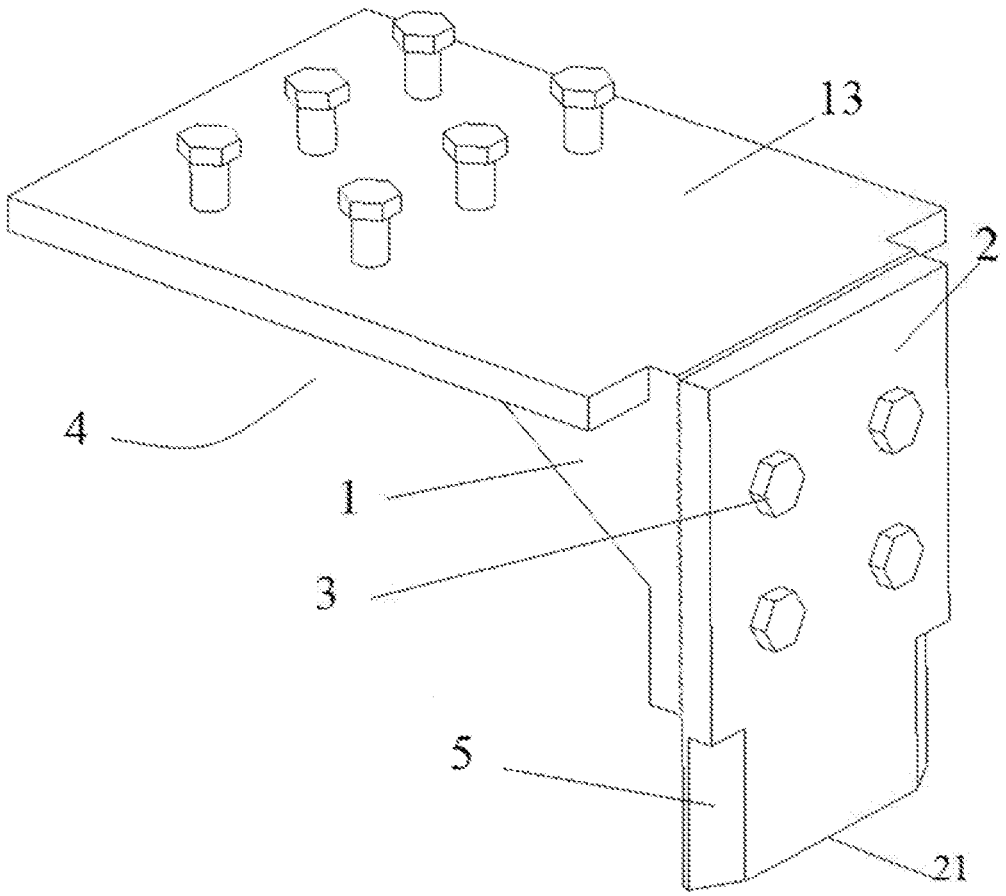
FIG. 1 is a schematic diagram of the structure of the anti-derailment apparatus of the disclosure.

As shown in FIGS. 1 and 3, both ends of the lower portion of the anti-derailment slide plate 2 of the embodiment are provided with a keep-space area 5. The keep-space area 5 is disposed particularly at the side of the anti-derailment slide plate 2 facing the ground rail, and the anti-derailment slide plate 2 provided with the keep-space area 5 is a tip shape or a wedge shape (equivalent to two chamfers with relatively great radius being disposed at both sides of the lower portion of the anti-derailment slide plate 2). As such, it can ensure that the whole anti-derailment apparatus 4 has good switch-passing performance and does not interfere with the ground rail 8.

Figure 5:
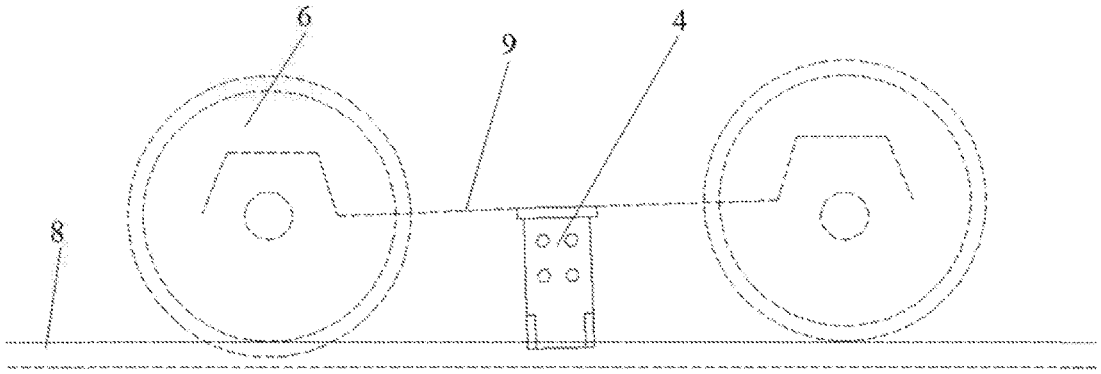
FIG. 5 is a schematic diagram showing the anti-derailment principle of the anti-derailment apparatus of the disclosure when a wheelset climbs rail.

In the embodiment, the transverse position of the anti-derailment slide plate 2 on the bogie 9 and the extending length thereof in the vertical direction are set to meet the following requirements simultaneously:

1) making the anti-derailment slide plate 2 located at the inside of the ground rail 8 when the rail vehicle runs normally (referring to FIG. 4);

2) when at least one wheelset 6 of the rail vehicle climbs rail, the anti-derailment slide plate 2 acts on the ground rail 8 to form lateral limitation points so as to limit the freedom of the rail vehicle and make it still constrained by the ground rail 8 (referring to FIG. 5).

As shown in FIG. 4, the transverse position of the anti-derailment slide plate 2 of the embodiment is achieved by controlling the lateral distance of the anti-derailment slide plate 2 and the flange 7 of the wheelset 6. In particular, in the embodiment, the transverse position of the anti-derailment slide plate 2 on the bogie 9 ensures that the anti-derailment slide plate 2 and the flange 7 are located at the same line (that is, the acting surface of the anti-derailment slide plate and the flange 7 are located in the same vertical plane). The extending length of the anti-derailment slide plate 2 of the embodiment in the vertical direction is achieved by controlling the height of the lower surface 21 (with respect to ground) of the anti-derailment apparatus (i.e., the anti-derailment slide plate 2), and the vertical length of the anti-derailment slide plate 2 of the embodiment ensures that the height of the lower surface 21 of the anti-derailment apparatus (i.e., the anti-derailment slide plate 2) is aligned with the height of the flange 7. As such, the contact of the middle anti-derailment slide plate 2 with the inside of the ground rail 8 is not ineffective while one wheelset 6 climbs rail, and the anti-derailment slide plate 2 can pass railway switches well and does not interfere with the ground rail 8.

Of course, the anti-derailment slide plate 2 in the disclosure should also have enough lateral strength, to ensure that the anti-derailment slide plate 2 does not generate a great deformation while suffering the lateral force. Further, the wheelset 6 climbing rail does not derail due to the excessive lateral deformation of the anti-derailment slide plate 2. And preferably, the anti-derailment apparatus 4 of the disclosure uses light-weight and wear-resistance materials, to ensure that the dynamics performance of the vehicle system does not deteriorate.

The anti-derailment apparatus 4 of the embodiment mainly applies to the situation where axle-box springs does not exist or axle-box springs have relatively great rigidity, and the operating principle upon applying is shown in FIG. 5. When the wheelset 6 at one side of the bogie 9 of a rail vehicle climbs rail, the anti-derailment slide plate 2 can still contact with the inside of the ground rail 8, and since a triangular system constituted by the rigidity of the bogie 9 and the contact of the anti-derailment slide plate 2 with the ground rail 8 forms a stable mechanism, a further lateral displacement of the wheelset 6 climbing rail is limited. Furthermore, the wheelset 6 climbing rail has an automatic centering function, and will resume to the normal position from the state of climbing rail, avoiding the occurrence of derailment.

The invention claimed is:

1. An anti-derailment apparatus for a bogie of a rail vehicle, characterized in that: the anti-derailment apparatus comprises at least one mounting seat (1) which is mounted at the bottom of the bogie (9) of the rail vehicle, and an anti-derailment slide plate (2) arranged on the mounting seat (1) extending toward the ground rail (8); the transverse position of the anti-derailment slide plate (2) on the bogie (9) and the extending length of the anti-derailment slide plate (2) in the vertical direction are set to meet the following requirements simultaneously:

1) always making the anti-derailment slide plate (2) located at the inside of the ground rail (8) when the rail vehicle runs normally;
2) when at least one wheelset (6) of the rail vehicle climbs rail, the anti-derailment slide plate (2) acts on the ground rail (8) to form lateral limitation points so as to limit the freedom of the rail vehicle and make it still constrained by the ground rail (8).

2. The anti-derailment apparatus according to claim 1, characterized in that: the anti-derailment apparatus comprises a pair of mounting seats (1) which are mounted at the bottom of the bogie (9), the pair of mounting seats (1) comprise a first mounting seat (11) which is located at the left side of the bottom of the bogie (9) and a second mounting seat (12) which is located at the right side of the bottom of the bogie (9), and each of the first mounting seat (11) and the second mounting seat (12) is configured with the anti-derailment slide plate (2).

3. The anti-derailment apparatus according to claim 1, characterized in that: the transverse position of the anti-derailment slide plate (2) is achieved by controlling a lateral distance between the anti-derailment slide plate (2) and a flange (7) of the wheelset (6).

4. The anti-derailment apparatus according to claim 1, characterized in that: the anti-derailment slide plate (2) and the flange (7) are located at the same line.

5. The anti-derailment apparatus according to claim 1, characterized in that: the extending length of the anti-derailment slide plate (2) in the vertical direction is not smaller than the height of the flange of the wheelset (6).

6. The anti-derailment apparatus according to claim 1, characterized in that: the extending length of the anti-derailment slide plate (2) in the vertical direction is achieved by controlling the height of the lower surface (21) of the anti-derailment apparatus, and the extending length of the anti-derailment slide plate (2) is configured so that the height of the lower surface (21) of the anti-derailment apparatus is aligned with the height of the flange.

7. The anti-derailment apparatus according to claim 1, characterized in that: the anti-derailment slide plate (2) is configured to be a slide plate of which the extending length is adjustable; the mounting seat (1) is provided with a strip-shaped sliding groove (15) which extends along the vertical direction, the anti-derailment slide plate (2) is fastened on the mounting seat (1) through a fastener which can slide upward and downward within the sliding groove (15); contact surfaces of the anti-derailment slide plate (2) and the mounting seat (1) are configured to be zigzag butting surfaces which mesh with each other.

8. The anti-derailment apparatus according to claim 1, characterized in that: the mounting seat (1) is an L shape, and the L shaped mounting seat (1) comprises a horizontal top surface (13) which can be fastened to the bogie (9) through a fastener, and also comprises a vertical side surface (14) which can be fastened to the anti-derailment slide plate (2) through another fastener.

9. The anti-derailment apparatus according to claim 1, characterized in that: both sides of the lower portion of the anti-derailment slide plate (2) are provided with a keep-space area (5); the keep-space area (5) is disposed particularly at the side of the anti-derailment slide plate (2) facing the ground rail, and the anti-derailment slide plate (2) provided with the keep-space area (5) is a tip shape or a wedge shape.

10. An anti-derailment bogie of a rail vehicle, comprising a bogie (9) and the anti-derailment apparatus according to claim 1, each side of each bogie (9) is mounted with the anti-derailment apparatus, the upper portion of the anti-derailment apparatus is mounted at the bottom of the bogie (9), and the lower portion of the anti-derailment apparatus hangs between the two front and rear wheelsets (6) to which the bogie (9) corresponds, and the bogie (9) is not provided with axle-box springs.

11. The anti-derailment apparatus according to claim 2, characterized in that: the anti-derailment slide plate (2) and the flange (7) are located at the same line.

12. The anti-derailment apparatus according to claim 3, characterized in that: the anti-derailment slide plate (2) and the flange (7) are located at the same line.

13. The anti-derailment apparatus according to claim 2, characterized in that: the extending length of the anti-derailment slide plate (2) in the vertical direction is not smaller than the height of the flange of the wheelset (6).

14. The anti-derailment apparatus according to claim 3, characterized in that: the extending length of the anti-derailment slide plate (2) in the vertical direction is not smaller than the height of the flange of the wheelset (6).

15. The anti-derailment apparatus according to claim 2, characterized in that: the extending length of the anti-derailment slide plate (2) in the vertical direction is achieved by controlling the height of the lower surface (21) of the anti-derailment apparatus, and the extending length of the anti-derailment slide plate (2) is configured so that the height of the lower surface (21) of the anti-derailment apparatus is aligned with the height of the flange.

16. The anti-derailment apparatus according to claim 3, characterized in that: the extending length of the anti-derailment slide plate (2) in the vertical direction is achieved by controlling the height of the lower surface (21) of the anti-derailment apparatus, and the extending length of the anti-derailment slide plate (2) is configured so that the height of the lower surface (21) of the anti-derailment apparatus is aligned with the height of the flange.

17. The anti-derailment apparatus according to claim 4, characterized in that: the extending length of the anti-derailment slide plate (2) in the vertical direction is achieved by controlling the height of the lower surface (21) of the anti-derailment apparatus, and the extending length of the anti-derailment slide plate (2) is configured so that the height of the lower surface (21) of the anti-derailment apparatus is aligned with the height of the flange.

18. The anti-derailment apparatus according to claim 5, characterized in that: the extending length of the anti-derailment slide plate (2) in the vertical direction is achieved by controlling the height of the lower surface (21) of the anti-derailment apparatus, and the extending length of the anti-derailment slide plate (2) is configured so that the height of the lower surface (21) of the anti-derailment apparatus is aligned with the height of the flange.

19. The anti-derailment apparatus according to claim 2, characterized in that: the anti-derailment slide plate (2) is configured to be a slide plate of which the extending length is adjustable; the mounting seat (1) is provided with a strip-shaped sliding groove (15) which extends along the vertical direction, the anti-derailment slide plate (2) is fastened on the mounting seat (1) through a fastener which can slide upward and downward within the sliding groove (15); contact surfaces of the anti-derailment slide plate (2) and the mounting seat (1) are configured to be zigzag butting surfaces which mesh with each other.

20. The anti-derailment apparatus according to claim 3, characterized in that: the anti-derailment slide plate (2) is configured to be a slide plate of which the extending length is adjustable; the mounting seat (1) is provided with a strip-shaped sliding groove (15) which extends along the vertical direction, the anti-derailment slide plate (2) is fastened on the mounting seat (1) through a fastener which can slide upward and downward within the sliding groove (15); contact surfaces of the anti-derailment slide plate (2) and the mounting seat (1) are configured to be zigzag butting surfaces which mesh with each other.

* * * * *